United States Patent [19]

Hirsch et al.

[11] Patent Number: 4,978,153

[45] Date of Patent: Dec. 18, 1990

[54] LATCH FOR A LABORATORY APPARATUS

[75] Inventors: Christian Hirsch, Bruchkobel; Dieter Schröder, Osterode; Eckart Kopowski; Helmut Köcher, both of Braunschweig, all of Fed. Rep. of Germany

[73] Assignee: Heraeus Sepatech GmbH, Osterode, Fed. Rep. of Germany

[21] Appl. No.: 373,944

[22] Filed: Jun. 29, 1989

[30] Foreign Application Priority Data

Jun. 29, 1988 [DE] Fed. Rep. of Germany ..... 3821840

[51] Int. Cl.[5] ..... E05C 3/24

[52] U.S. Cl. ..... 292/201; 292/216

[58] Field of Search ..... 292/201, 216, 210, 198

[56] References Cited

U.S. PATENT DOCUMENTS

| | | | |
|---|---|---|---|
| 3,504,511 | 4/1970 | Allen | 292/201 X |
| 4,203,621 | 5/1980 | Noel et al. | 292/216 |
| 4,756,563 | 7/1988 | Garwood et al. | 292/216 |
| 4,783,102 | 11/1988 | Bernard | 292/216 |

FOREIGN PATENT DOCUMENTS

| | | | |
|---|---|---|---|
| 2816395 | 10/1979 | Fed. Rep. of Germany . | |
| 3120787 | 4/1982 | Fed. Rep. of Germany . | |
| 918165 | 2/1963 | United Kingdom | 292/201 |

OTHER PUBLICATIONS

Suprafuge 22 (Brochure 2M8.87/N Kr.), Heraeus Sepatech GmbH, 3360 Osterode am Harz.

*Primary Examiner*—Lloyd A. Gall

*Attorney, Agent, or Firm*—Frishauf, Holtz, Goodman & Woodward

[57] ABSTRACT

A latch is known for a laboratory apparatus, for locking a cover or door on its housing, having a hook 12 in one of the parts to be locked and a lock 1 in the other. The lock has a pivotable locking element 3 with a claw-shaped opening 9 which engages the hook 12 against the pressure of a spring and is releasable from engagement with the hook by an actuating element 7. In order to provide a latch of this kind with means to meet strict safety requirements and ensure secure locking during operation of the apparatus, an additional closing element 4, opening element 5, and securing element 6, which engage one another, are disposed between the locking element 3 and the actuating element 7.

22 Claims, 1 Drawing Sheet

LATCH FOR A LABORATORY APPARATUS

The present invention relates to a latch for a laboratory apparatus for locking a cover or a door on its housing, with a hook in one of the parts to be locked and a lock in the other. The lock has a pivotable locking element with a claw-shaped opening which engages the hook against the pressure of a spring and is releasable from engagement with the hook by an actuating element.

BACKGROUND OF THE INVENTION

A latch of this kind is used for example for locking the cover of a laboratory centrifuge. A laboratory centrifuge of this kind is known, for example, from the product information provided by Heraeus Sepatech GmbH, 3360 Osterode am Harz, on the "Suprafuge 22" (Brochure 2M8.87/N Kr). This centrifuge has a housing with a cover on the top which is openably fastened by two hinges. On the side opposite the hinges, two hooks in the form of eyes are ridigly fastened in the cover, said hooks each engaging a matching lock which is depressed into and fastened in the housing.

Increasingly strict safety measures are being demanded for laboratory equipment, centrifuges for example, including the field of latches for covers which ensure reliable locking of the cover to the housing during operation of the centrifuge under extreme loads, like those which occur, for example, if a rotor bursts.

SUMMARY OF THE INVENTION

An object of the present invention is to provide a latch for a laboratory apparatus which meets strict safety requirements and ensures reliable locking during operation of the apparatus, especially under external vibrations or other stresses.

Briefly, the apparatus of the present invention features a closing element engaging the locking element under spring force and an opening element communicating with the actuating element and acting on the closing element. The opening and closing elements are pivotably disposed between the latching element and the actuating element, and a securing element engaging the opening element and the closing element is pivotably disposed between them, abutting the opening element under spring force.

The pivot axes of the closing element, locking element, opening element, and securing element run parallel to one another. The opening element has at one end a guide surface for the securing element, and at its other end, a locking nose which engages behind the projection on the closing element in the locking position. The securing element has in a middle area of its guide surface a retaining nose into which a cam of the opening element engages in the opening position.

In the locking position, the closing element has at the end opposite the opening element, a first groove into which a first projection of the locking element, which delimits the claw-shaped opening on one side, engages.

The securing element on the pivot side located opposite the guide surface and the retaining nose, by means of an actuating cam on the locking element in the open position, is pivotable so that it releases the retaining nose of the securing element from engagement with the opening element.

The lock is designed in such fashion that the actuating element does not act directly on the locking element, but the movement of the actuating element is transmitted by two additional elements, the opening element and the closing element. With the aid of these two elements as well as the securing element, various securing functions can be incorporated. The securing element ensures that when the latch is opened, the closing element which abuts the opening element remains in an open position, since the cam disposed at the end of the opening element engages the retaining nose of the securing element.

Immediately after the locking element has pivoted into the open position which releases the hook, the securing element is pivoted by the actuating cam in such fashion that the retaining nose releases the cam of the opening element, thus ensuring that the closing element, upon closure of the door or cover and hence of the hook that then engages the claw-shaped opening, can again pivot into the locking position under the force of the spring engaging the closing element, so that the first projection engages the first groove of the closing element, thus locking the locking element. An additional protection is provided by the projection of the closing element which abuts the locking nose of the opening element in the locking position when forced to pivot under the influence of outside forces in the direction of the opening position.

The opening element can be actuated in a simple fashion, by an actuating element in the form of a lifting magnet which displaces the opening element to open the lock.

As an additional safety measure, it is advantageous to actuate at least one switch, by using the movement of the closing element which directly releases or locks the locking element. By means of this switch, located in a position in which the closing element releases the locking element, one can interrupt at least one operating function, for example the circuit supplying the drive motor of a centrifuge, so that operation of the centrifuge becomes impossible when the cover is open.

In another advantageous embodiment of the latch, the opening element abuts the actuating element under the force of a spring. This ensures that, after closing of the lock, i.e., after the hook is again forced into the claw-shaped opening in the locking element, the plunger of the lifting magnet is pushed back into its initial position by the rotating closing element which presses on the opening element.

Additional securing for the locking element in the locking position is provided by a second groove in the closing element into which a second projection of the locking element, which delimits the claw-shaped opening on the other side, in other words, on the side opposite the first projection, engages. With such a design of the lock, the locking element is secured at two points against opening by force.

A pair of surfaces between the locking element and the closing element has proven successful, said pair abutting one another in the position of the closing element in which it is swung out of the projection, during swinging of the locking element into the position which releases the hook. This prevents the projections and grooves which secure the locking element from engaging one another, while the locking element, as the door is closed, is guided reliably by the hook, by means of the surfaces, into a position in which the pins can engage the grooves. Since all the pivot axes of the elements used, i.e. the locking element, closing element, opening element, and securing element, run parallel to one another, especially when the elements are made as flat components of limited thickness, the entire lock can be kept very flat so that it can be incorporated into the ordinary housing wall of a laboratory apparatus.

DRAWING

One embodiment of the invention will now be described in greater detail with reference to the single figure, which shows a lock according to the invention, in a locking position with the hook engaged.

DETAILED DESCRIPTION

Figure 1:
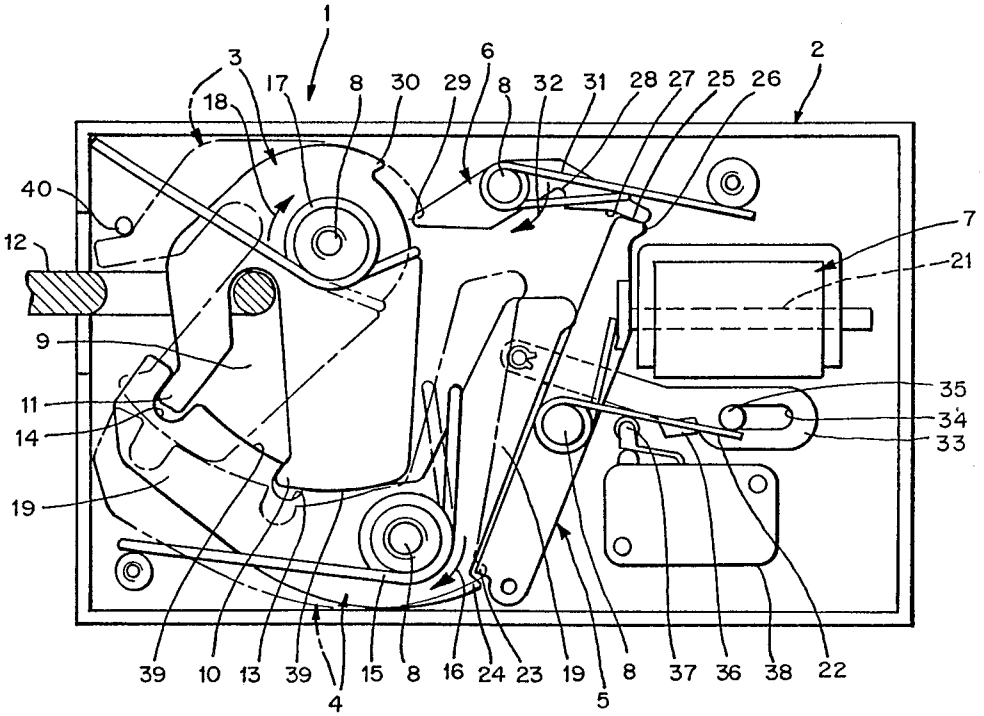

The latch comprises a lock 1 with a housing 2, in which a locking element 3, a closing element 4, an opening element 5, a securing element 6, and an actuating element in the form of a lifting magnet 7 are disposed. The pivot axes 8 of elements 3, 4, 5, 6, and 7 enumerated above run parallel to one another. Locking element 3 has a claw-shaped opening 9 delimited by a first projection 10 and a second projection 11. The bottom area of claw-shaped opening 9 matches a hook 12 engaging therein, said hook being disposed for example on a door. In the locking position shown in the figure, first projection 10 engages a first groove 13 and second projection 11 engages a second groove 14 of closing element 4. Closing element 4 is held in this locking position by a spring 15, acting in the direction of arrow 16. A spring 17 engages locking element 3, said spring keeping locking element 3 tensioned in the direction of arrow 18, so that projections 10 and 11 are held against the walls of grooves 13 and 14. The force of spring 17 rotates locking element 3 into an opening position in the direction of arrow 18 after the two projections 10 and 11 have been released by closing element 4, so that hook 12 is released from the claw-shaped opening.

Closing element 4 has two legs 19 extending at an angle of approximately 90° to one another. Outer leg 19 has both grooves 13 and 14 on its inner surface and inner leg 19 abuts opening element 5 at its end by means of a projection 20. Opening element 5 is a rod-shaped part whose pivot axis 8 runs approximately through its center. Plunger 21 of lifting magnet 7 presses against the lower part of opening element 5 as seen from pivot axis 8. Opening element 5 is held in the locking position shown by means of a spring 22. At the lower end of opening element 5 is a locking nose 23 associated with a projection 24 of closing element 4. Projection 24 is located at approximately the same height as pivot axis 8 of closing element 4.

The other, upper end of opening element 5 is formed end-wise as guide surface 25 with an additional cam 26 projecting laterally outward. A guide surface 27 of securing element 6 is guided on guide surface 25 until opening element 5 at its upper end pivots leftward into an opening position and a retaining nose 28 engages cam 26. The end which is opposite guide surface 27, as viewed from pivot axis 8, has associated with it an actuating cam 30 on the outside of locking element 3, which cam comes to rest against this end 29 in the opening position and pivots securing element 6. A spring 31 engages securing element 6, said spring rotating securing element 6 in the direction of arrow 32 and holding its, guide surface 27 against guide surface 25 of opening element 5.

As shown at lower right, an actuating lever 33 is articulated to leg 19 of closing element 4 whose end abuts opening element 5, said lever 33 being guided at its other end by an elongated hole 34 on a pin 35. This actuating lever 33 incorporates a switching cam 36 which in a position of closing element 4 in which it is pivoted into the opening position, actuates switch arm 37 of a microswitch 38. This microswitch 38 in the open position can be used to interrupt circuits, for example the circuit of the drive motor of a centrifuge.

In order to release hook 12 from the locking position shown by means of lock 1, lifting magnet 7 is energized and its plunger 21 pivots opening element 5 until its cam 26 engages retaining nose 28 of securing element 6. At the same time, locking nose 23 at the other end of opening element 5 pivots out of the range of engagement of projection 24 in closing element 4. Closing, element 4 is pivoted by opening element 5 so that projections 10 and 11 are disengaged from grooves 13 and 14. Then locking element 3 and closing element 4 are guided against each other along their respective surfaces 39 until locking element 3 is pivoted by spring 17 in the direction of arrow 18 with the outside of second projection 11 against a stop formed by a pin 40; in this position, hook 12 is released from claw-shaped opening 9.

To lock the cover or door with hook 12, hook 12 is inserted into claw-shaped opening 9, which then comes to rest against the surface as an extension of first projection 10 and locking element 3 pivots into its closed position opposite to the rotational direction shown by arrow 18, i.e., against the force of closing spring 17. This causes locking element 3 and spring element 4 to be guided with respect to one another by surface pair 39 until first projection 10 and second pin 11 engage the corresponding first groove 13 and second groove 14. The pivoting of closing element 4 causes plunger 21 of lifting magnet 7 to be pushed back into its initial position, as shown in the figure, by opening element 5.

I claim:

1. A latch for a laboratory apparatus, for locking a closing panel to its housing, having a hook (12) in one of said panel and said housing and a lock (1) in the other of said panel and said housing, said lock having a pivotable locking element (3) with a claw-shaped opening (9) which engages the hook against the pressure of a spring (17) and which is releasable from engagement with the hook (12) by an actuating element (7), comprising, in accordance with the invention, a closing element (4), which engages said locking element (3) under spring force, and an opening element (5), which engages a portion (21) of said actuating element (7) and acts on closing element (4), said opening and closing elements being pivotably disposed between said locking element (3) and said actuating element (7), for movement between a locking position and an opening position;

a securing element (6), which engages opening element (5) and locking element (3), pivotably abutting opening element (5) under spring tension, disposed between said opening element (5) and said locking element (3), and wherein pivot axes (8) of locking element (3), closing element (4), opening element (5), and securing element (6) run parallel to one another, wherein opening element (5) has at one end a guide surface (25) for securing element (6), and at the other end a locking nose (23) which in said locking position fits behind a projection (24) on closing element (4), wherein securing element (6) has a retaining nose (28) in a middle area of a guide surface, into which nose a cam (26) of opening element (5) engages in the opening position, wherein closing element (4) has a first groove (13) at an end opposite opening element (5) in the locking position, into which groove (13) a first projection (10) of locking element (3), which delimits the claw-shaped opening (9) on one side, engages, and wherein securing element (6), on a pivot side which is opposite guide surface (27) and retaining nose (28), is releasably pivotable by an actuating cam (30) on locking element (3) in the opening position, releasing retaining nose (28) of securing element (6) out of engagement with opening element (5).

2. Latch according to claim 1, wherein said actuating element (7) is a lifting magnet.

3. Latch according to claim 2, wherein locking element (3) and closing element (4) have a pair of surfaces (39) which, in the position of closing element (4), swung out from projections (10, 11) abut one another as locking element (3) is swung into the position which releases hook (12).

4. Latch according to claim 2, wherein locking element (3), closing element (4), opening element (5), and securing element (6) are flat components of limited thickness.

5. Latch according to claim 2, wherein the movement of closing element (4) actuates at least one switch (38) which, in one position of closing element (4) which releases rocking element (3), interrupts an operating function of the laboratory apparatus.

6. Latch according to claim 5, wherein closing element (4) has a second groove (14) into which a second projection (11) of locking element (3), which delimits claw-shaped opening (9) on the other side, engages.

7. Latch according to claim 6, wherein locking element (3), closing element (4), opening element (5), and securing element (6) are flat components of limited thickness.

8. Latch according to claim 5, wherein locking element (3) and closing element (4) have a pair of surfaces (39) which, in the position of closing element (4), swung out from projections (10, 11) abut one another as locking element (3) is swung into the position which releases hook (12).

9. Latch according to claim 2, wherein opening element (5) abuts actuating element (7) under the force of a spring (22).

10. Latch according to claim 9, wherein locking element (3) and closing element (4) have a pair of surfaces (39) which, in the position of closing element (4), swung out from projections (10, 11) abut one another as locking element (3) is swung into the position which releases hook (12).

11. Latch according to claim 9, wherein locking element (3), closing element (4), opening element (5), and securing element (6) are flat components of limited thickness.

12. Latch according to claim 2, wherein closing element (4) has a second groove (14) into which a second projection (11) of locking element (3), which delimits claw-shaped opening (9) on the other side, engages.

13. Latch according to claim 1, wherein the movement of closing element (4) actuates at least one switch (38) which, in one position of closing element (4) which releases locking element (3), interrupts an operating function of the laboratory apparatus.

14. Latch according to claim 13, wherein locking element (3), closing element (4), opening element (5), and securing element (6) are flat components of limited thickness.

15. Latch according to claim 13, wherein opening element (5) abuts actuating element (7) under the force of a spring (22).

16. Latch according to claim 13, wherein locking element (3) and closing element (4) have a pair of surfaces (39) which, in the position of closing element (4), swung out from projections (10, 11) abut one another as locking element (3) is swung into the position which releases hook (12).

17. Latch according to claim 1, wherein opening element (5) abuts actuating element (7) under the force of a spring (22).

18. Latch according to claim 17, wherein locking element (3) and closing element (4) have a pair of surfaces (39) which, in the position of closing element (4), swung out from projections (10, 11) abut one another as locking element (3) is swung into the position which releases hook (12).

19. Latch according to claim 17, wherein locking element (3), closing element (4), opening element (5), and securing element (6) are flat components of limited thickness.

20. Latch according to claim 1, wherein closing element (4) has a second groove (14) into which a second projection (11) of locking element (3), which delimits claw-shaped opening (9) on the other side, engages.

21. Latch according to claim 1, wherein locking element (3) and closing element (4) have a pair of surfaces (39) which, in the position of closing element (4), swung out from projections (10, 11) abut one another as locking element (3) is swung into the position which releases hook (12).

22. Latch according to claim 1, wherein locking element (3), closing element (4), opening element (5), and securing element (6) are flat components of limited thickness.

* * * * *